US005355949A

United States Patent [19]

Sparlin et al.

[11] Patent Number: 5,355,949

[45] Date of Patent: Oct. 18, 1994

[54] WELL LINER WITH DUAL CONCENTRIC HALF SCREENS

[76] Inventors: Derry D. Sparlin, 9803 Oxted La., Spring, Tex. 77379; Tadayoshi Nagaoka, No. 2-2-91, Mokuzaidouri Mihara-Cho, Minamikawachi-gun, Osaka, Japan, 587

[21] Appl. No.: 52,158

[22] Filed: Apr. 22, 1993

[51] Int. Cl.[5] ..... E21B 43/00

[52] U.S. Cl. ..... 166/236

[58] Field of Search ..... 166/236, 227, 229, 231, 166/232, 233, 234

[56] References Cited

U.S. PATENT DOCUMENTS

| | | | |
|---|---|---|---|
| 3,379,259 | 4/1968 | Metler | 166/236 X |
| 4,476,925 | 10/1984 | Cox | 166/236 X |
| 4,771,829 | 9/1988 | Sparlin | 166/236 X |

*Primary Examiner*—William P. Neuder
*Attorney, Agent, or Firm*—Bernard A. Reiter

[57] ABSTRACT

A well liner having dual concentric half screens for filtering sand and undesirables from fluids, gases, and toxic extractions. The well liner provides concentric half bodied screens of opposite orientation to provide a tortuous flow of path for the production fluids. The screens are manufactured by techniques well known in the art in the preferred embodiment. Two screen members are provided each comprising two annular portions: a screen portion and a solid pipe portion. The inner screen member is inserted in the outer screen member and both members are welded at each end. Additionally, an apertured base pipe may be provided. In the alternate embodiment, an apertured base pipe is surrounded by two full screen tubular members. A tortuous flow path is created in the alternative embodiment by the placement of shield members along a portion of the inner and outer screens. Additionally, the shields may be varied depending upon the placement of the apertures along the base pipe. These well liners are particularly suited for horizontal or high angle wells requiring a tortuous flow path where formation sand is likely to clog the well liners. The well bores may further be gravel packed to prevent or limit formation sand movement.

40 Claims, 5 Drawing Sheets

WELL LINER WITH DUAL CONCENTRIC HALF SCREENS

BACKGROUND OF THE INVENTION

1. Field of the Invention

This invention relates generally to the field of oil well, gas well, water well and subterranean pollution remediation well equipment, and more particularly to a dual concentric half screen for filtering sand and undesirable solids from fluids, gases, and toxic extractions.

2. Brief Description of Prior Art

Many types of screens and filtering devices are known in the art that are designed to exclude sand and other solids from fluids and gases produced from oil, gas, water, and pollution remediation wells without undue restriction of the production rate of fluids or gases. These devices are sometimes used as the sole means of excluding solids, and are otherwise used with filter aids, such as gravel and/or sand, which are either incorporated within the device or are separately placed surrounding the device.

Wire wrapped screens, slotted liners, and perforated liners are examples of devices used inside a drilled hole. The drilled hole may be left open or may have a casing or liner cemented and perforated prior to positioning such a device. Openings in such screens and liners may be designed to stop, or bridge, undesirable solids contained in fluids. Screen and well liners are sometimes surrounded by filter aids. The filter aids consist commonly of gravel. When used with filter aids or gravel, the openings in the screens and liners are designed to stop or bridge the filter aid and the filter aid is designed to stop or bridge the undesirable solids contained in the produced fluids.

Prepacked screens, porous media filter devices and such, are examples of devices that incorporate a filter media in the screen body. These devices are used for the same purpose with and without additional filter aids in the well bore. These filter aids commonly consist of gravel.

Multiple wrap screens provide two or more concentric wire wrappings which act as multiple filters in one device to prevent invasion of undesirable solids and are used with or without additional filter aids in the well bore.

One problem that all of the prior art devices have in common is that they are subject to erosion by fluids or gases that flow through them and by the particles that are carried through them by the produced fluids and/or gases. Multiple wrapped screens, prepacked screens, and other screen devices that incorporate a filter aid as part of the body of the device, physically resist but often do not stop the effect of such erosion. Another common problem is that screens, liners, and especially prepacked screens are that they are all easily clogged or partially clogged by solids that fill the openings of the screens or fill the pores of the filter aids contained in the device, or surrounding device, thus reducing their capacity to transmit fluids or gases.

Another common problem is created when the fluid that carries the gravel easily flows into the screen as it is being pumped down the screen/casing, or screen/-hole annulus. This reduces the velocity of the carrier fluid in the annulus, thereby increasing the gravel concentration and interfering with the transport of gravel over the entire screen length. This is especially a problem in high angle holes, deviating from the vertical by 45 degrees to 90 degrees plus, as gravity forces the gravel to the low side of the hole and forms "dunes" that interfere with subsequent movement of gravel down the annulus. As gravel accumulates, the carrier fluid is diverted to the high side of the well bore and into the screen, thereby reducing the velocity of the carrier fluid flowing in the outer annulus and the capability of the fluid to force gravel toward the bottom, or the end, of the screen.

Very long (100 to 2,000 plus feet), high angle (45 degrees to 90 degrees plus) well bores are especially difficult to pack with gravel because the gravel is preferentially deposited on the low side of the hole by gravity as the gravel is being pumped and after the pumping stops, the gravel tends to settle, leaving the top of the screen uncovered. Thereafter, the uncovered portion of the screen is subject to erosion by solids entrained in produced fluids and/or gases, and the screen openings are more readily clogged by the undesirable solids.

The problem with multiple concentric wire wrapped screens is that fluids, gases and solids entrained therein erode holes because there is little resistance to flow through the screens and because these holes do not provide any means of restricting bypassing of gravel carrier fluids from the screen/casing or screen/open hole annulus.

The art known in this field simply does not address all of these issues and problems. For example, Metler, U.S. Pat. No. 3,279,259, attempts to prevent this problem by providing a well screen assembly that is comprised of a plurality of concentric pipes. Each of the sleeves or pipes have perforations that are staggered in respect to the perforations in the next adjacent sleeve so that erosive fluid entering the well is forced to follow a tortuous flow path before it impinges on the tubing.

McLaughlin, et al., U.S. Pat. No. 1,594,788, shows a well screen that uses concentric tubes or sleeves. The slots or openings in the two sleeves have different shapes to prevent wear.

Thompson, U.S. Pat. No. 2,681,111, discloses a screen with perforations that are also staggered between adjacent sleeves.

Other relevant patents include Grubsbeck, et al., U.S. Pat. No. 4,046,198; Maly, et al., U.S. Pat. No. 3,637,010; Sparlin, U.S. Pat. No. 4,771,829; Van Westrum, U.S. Pat. No. 2,155,744; Burns, U.S. Pat. No. 2,942,664; Chancellor, et al., U.S. Pat. No. 3,153,451; Jones U.S. Pat. No. 3,428,128; and Gurley, et al, U.S. Pat. No. 3,789,927.

BRIEF DESCRIPTION OF THE INVENTION

The present invention is distinguishable over the prior art by its provision for concentric screens wherein both are approximately half screen and half blank wall. The two members are oriented so that the screen of one member is opposite the blank wall of the other member. This provides a solid, erosion resistent barrier immediately behind the outer screen member and is centralized to allow passage of fluids and gases between the inner and outer screens. The blank wall of the inner screen body, opposite the screen portion of the outer body, deflects fluids, gases, and solids entrained therein and reduces the ease with which gravel carrying fluid may bypass through the screen, and the inner screen provides a backup filter positioned behind the erosion resistent barrier of the outer member.

The blank portion of the outer member may be oriented toward the high side of a high angle or horizontal well bore, by well known technology, to provide a barrier to solids that fall from the high side of the well bore. Gravel that settles on the low side of the well bore will be protected by the low side screen from becoming clogged. Any solids are prevented from entering the inner cavity of the well liner because of the tortuous path that the fluid must travel. The solids entrained in the travelling fluid or gas must counteract gravitational forces in order to flow into the outer screen on the low side portion of the device because it must then be transported through the inner annulus to the inner screen that is positioned toward the top side of the outer member and pass through the second filter into the inner cavity for transportation to the surface. Therefore, gravity inhibits the flow of solids into both screens. The gravel accumulated on the low side of the well bore inhibits the flow of solids into the outer screen. Openings of the screens may be larger than openings of gravel pores in prepacked screens so that the screens are less subject to clogging by solids.

It is therefore an object of this invention to provide a well screen having concentric half screen liners of opposite orientation that will protect the screen from erosion by fluids, gases, and solids entrained therein without the need to incorporate gravel, and such, as part of the screen.

A further object is to provide a screen that will enhance the transportation of the gravel in the screen/casing or screen/open hole annulus of a high angle or a horizontal well bore.

A further object of this invention is to provide a means for using gravitational forces to reduce the invasion of solids into the screen in high angle and horizontal well bores.

It is a further object of this invention to provide a back up screen by which the flow of undesirable solids may be stopped.

A further object is to provide means of using gravel that only needs to fill the low side of a high angle or horizontal well bore as an external filter aid. These and other objects and features will be clearly understood upon reading of the following Detailed Description, claims and drawings, wherein like numerals denote like parts in the several views and wherein:

The sealed circumference of the inner screen shall be equal to or overlap the sealed circumference of the outer screen while the outer screen shall be equal to or overlap the sealed circumference of the inner screen.

DETAILED DESCRIPTION OF THE INVENTION

Figure 1:
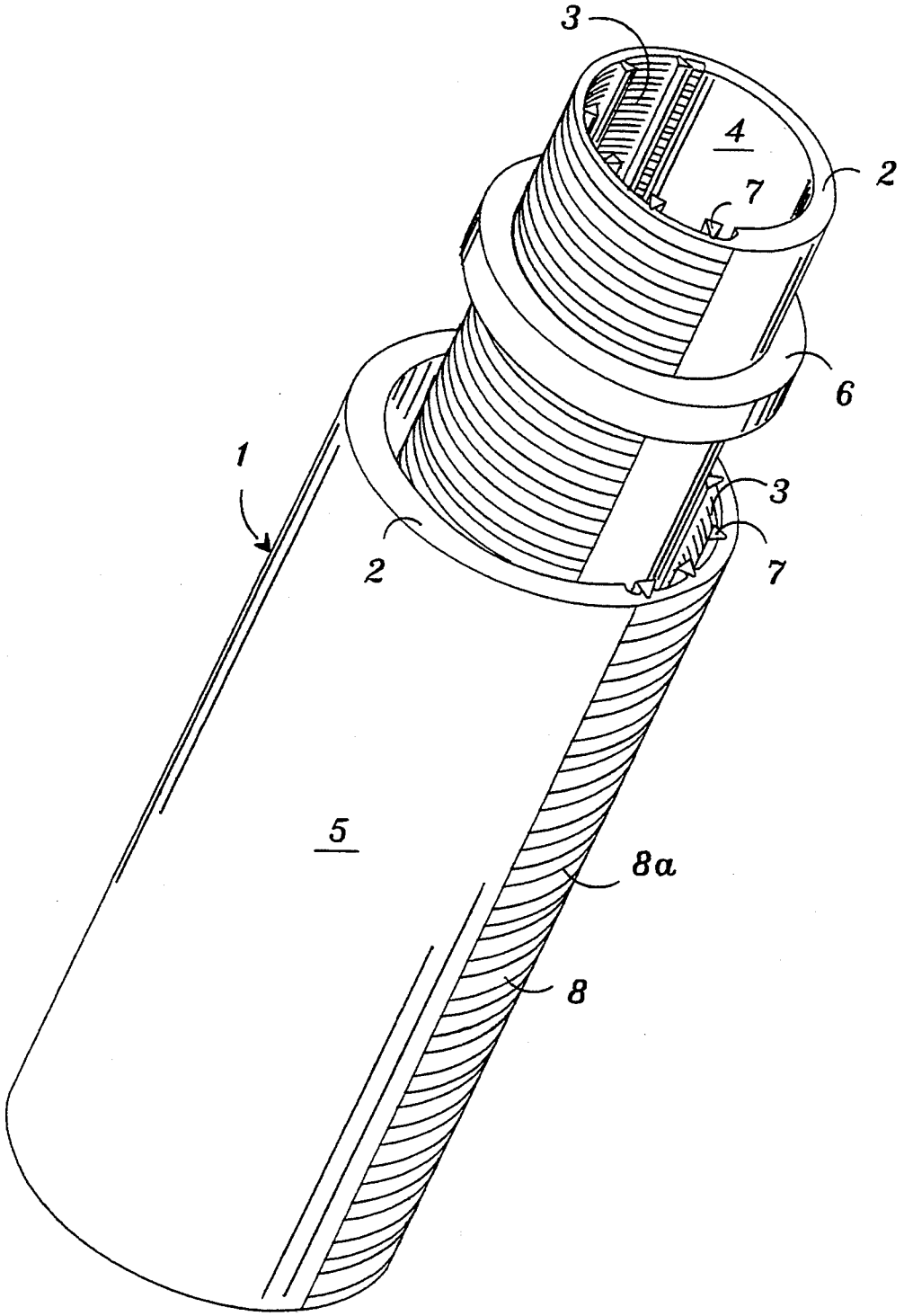
FIG. 1 illustrates a perspective view of the preferred embodiment.
Figure 6:
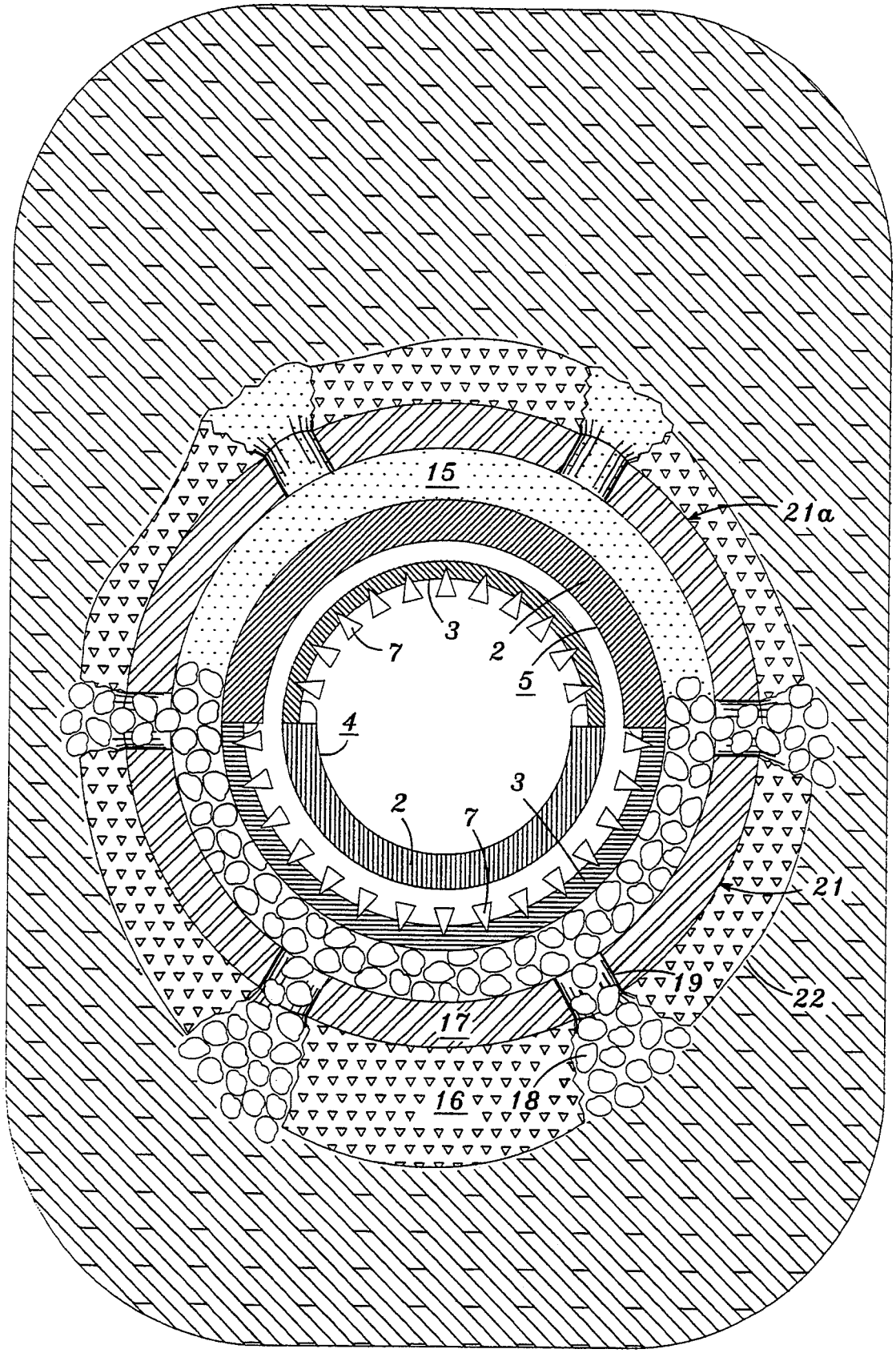
FIG. 6 discloses a cross-sectional view of the preferred embodiment in a cased well bore.
Figure 7:
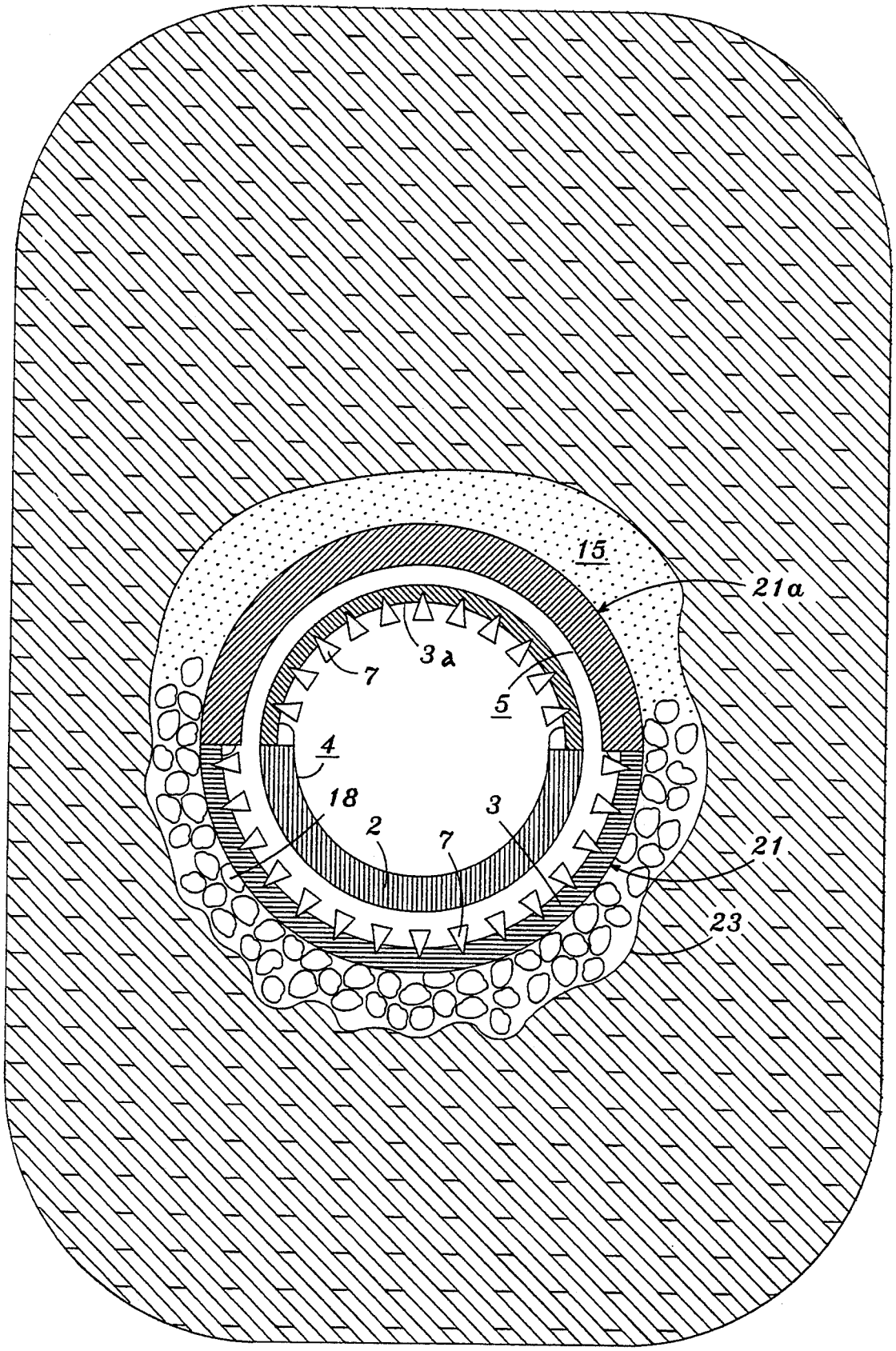
FIG. 7 discloses a cross-sectional view of the preferred embodiment in a well bore that is not cased.

The invention is designed and manufactured in a variety of ways that accomplish the desired objectives or results, examples of which are shown in the figures accompanying this disclosure. FIG. 1 discloses an example of the preferred embodiment 1 manufactured and fabricated of common wire wrapped screens 3 of two different diameters. Each screen 3 is manufactured by having wire wrapping 8 welded onto support rods 7 using techniques and materials well known in the art. Each screen 3 is then cut approximately in half axially or longitudinally, and welded onto an accompanying tubing or base pipe 2 which has been similarly cut to match the size and diameter of the wire wrapped screen 3. Thus, the two half screen/half pipe members 4, 5 form the well liner filtering sand and gravel from the production fluid. The smaller inner member 4 is inserted into the larger outer member 5 and welded together at each end to form the single body of the invention 1. Centralizers 6 may be also optionally inserted at intervals, between the smaller inner member 4 and the larger outer member 5, especially for relatively long screens. FIGS. 6 and 7 disclose the preferred embodiment as disposed in a horizontal well 22. The well 22 has a high side 21*a* and a low side 21. Gravel packed wells contain gravel 18 to limit formation sand 15 movement. Gravel 18 usually settles to the low side 21 because of gravity. FIG. 6 further discloses a cement casing 16 and a metal casing 17 defining the well 22. The well 22 is perforated 19 in several directions to maximize production.

The arc of the screen 3 may be less than one-half of the circumference of the tubular members 4, 5 for a more efficient operation of the invention, although it need not be so. Each wire wrapped screen 3 that is cut less than half its circumference will obviously be welded onto a corresponding base pipe 2 proportionately cut to form the tubular well liner 1, i.e., the arcs of the two half annular members are such that when welded together they form a full circular configuration. Thus, the preferred ratio of the smaller inner member 4 should be one-half or less of wire wrapped screen 3 and, conversely, one-half or more solid pipe 2. For the larger outer member 5, the ratio should also be the same, and therefore, for example, when the wire wrapped screen 3 is one-half of the circumference, the solid pipe 2 would also be one-half of the circumference. Each ratio must be determined pursuant to well requirements and not a predetermined, specified ratio.

The relationship between the ratios of the inner (smaller) 4 and outer (larger) 5 members is also important. For the production fluid to have a tortuous flow path, no direct inner screen 3 to outer screen 3 flow path must exist. The tortuous path prevents or limits erosion. Thus, if the outer screen 3 has an arc of 270 degrees, then the inner screen 3 must have a corresponding arc of less than 90 degrees. It is important that the solid base pipe 2 of the outer member 5 overlap the screen 3 of the inner member 4. Additionally, another provision for preventing erosion may be to optionally add an elongate tubular member having a plurality of spaced apertures inserted within the inner member 4. This provision will further enhance the transportation capability of the production fluid to the surface. Again, the plurality of apertures may be directed to only a portion of the base pipe to further enhance a tortuous path that the production fluid must travel. If apertures exist along the full periphery of the base pipe, for whatever reason, a portion may be covered by affixing plates (metal or plastic) to prevent fluid communication. It is important to have a concentric alignment between the solid (plated) portion of the base pipe and the screen portion 3 of the inner member 4 for a tortuous path.

Figure 3:
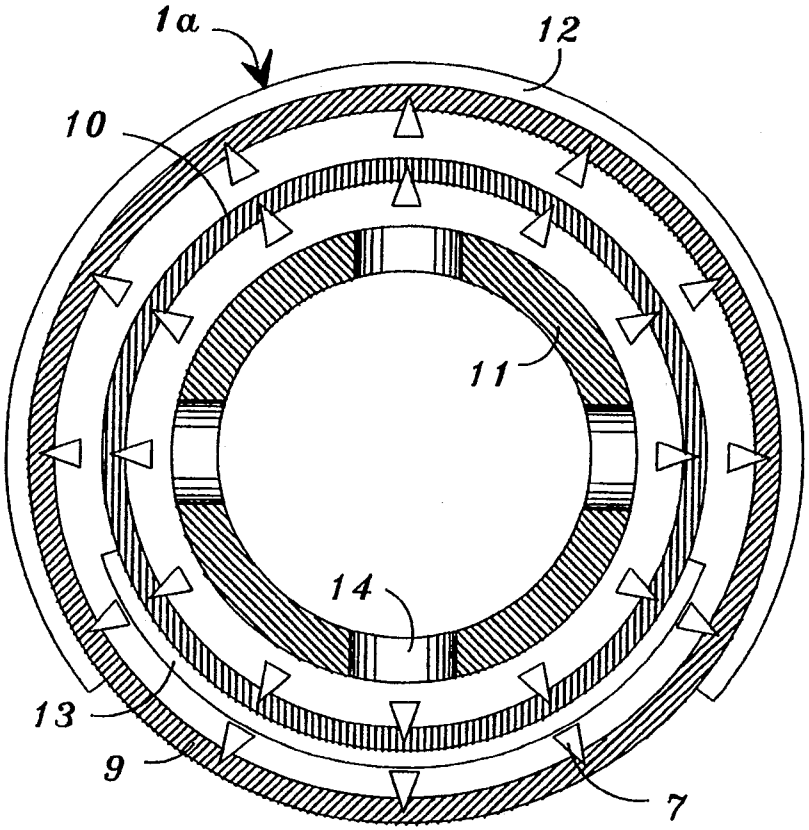
FIG. 3 illustrates a cross-sectional view of the alternate embodiment in FIG. 2 with a variation on the shield sizes.
Figure 2:
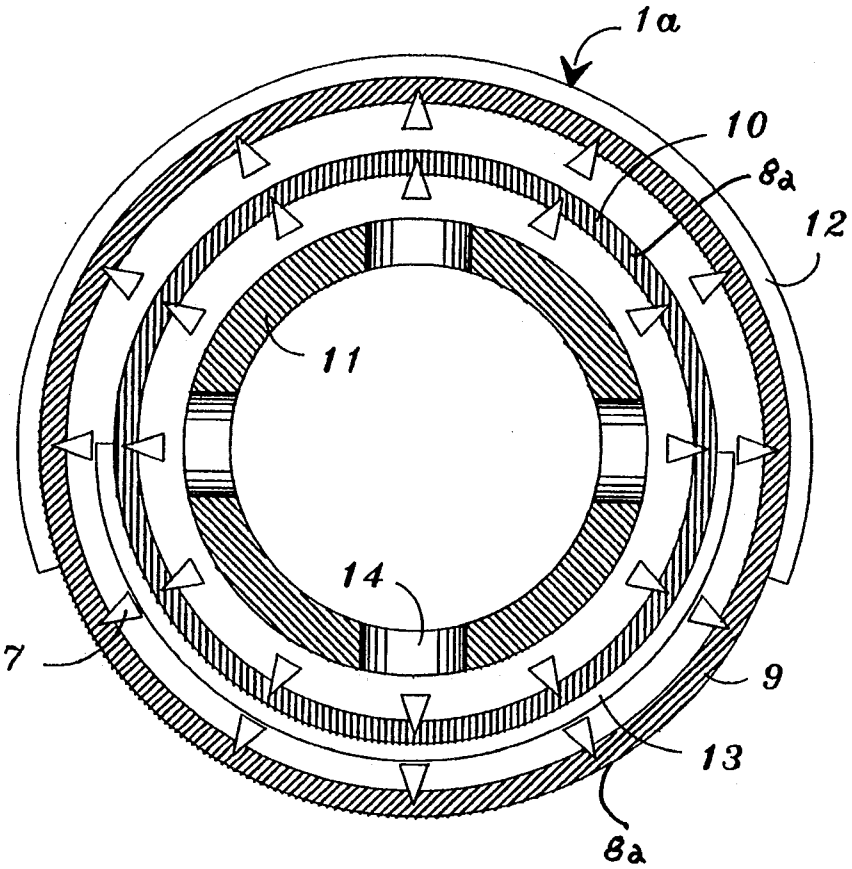
FIG. 2 illustrates a cross-sectional view of the alternate embodiment disclosing a base pipe and two filtering screens surrounding the base pipe.

An alternate embodiment is shown in FIGS. 2 and 3. Two tubular members 9, 10 are fabricated by having screens made using techniques and materials well known in the art. The wire wrapping 8 is welded onto support rods 7 to form the screens. In the preferred design 1*a* of the alternate embodiment (FIG. 2), approximately one-half or more of the larger outer screen 9 is covered with a thin metal or plastic plate 12 and approximately one-half or less of the smaller inner screen 10 is covered with a thin metal or plastic plate 13 to prevent flow and therefore creating a tortuous flow path. The outer and inner plates 12, 13 are affixed, by welding or bonding materials, to the full length of each screen 9, 10 to fully seal the openings or gaps 8*a* between the wire wrapping 8 over the areas that they cover. A sealant may be substituted for the thin plate 12, 13 to accomplish the same purpose of fully sealing the openings or gaps 8*a* in each screen 9, 10. The smaller inner screen 10 is then inserted into the larger outer screen 9 and oriented so that the sealed or shield portions of the screen members opposingly face each other. The ends of the two screen members 9, 10 are then welded together. To complete the unit, a perforated or apertured or slotted support 14 or base pipe 11, such as those commonly used in a wire wrapped screen manufacturing is inserted and welded at each end to the unit. In some cases, a support or base pipe 11 may be welded onto short sections of pipe at each end to make threaded connections to couple other lengths of pipe or well liners. In so doing, it is important to have a tortuous path from the well bore 22, 23 to the base pipe 11. Thus, the alignment of the perforated or apertured base pipe 11 to the inner screen 10, and the inner screen 10 to the outer screen 9 must be such that each solid area opposingly faces the screen area. The periphery of each member may be adjusted depending on well requirements. Therefore, each member individually may have full or partial openings.

Figure 5:
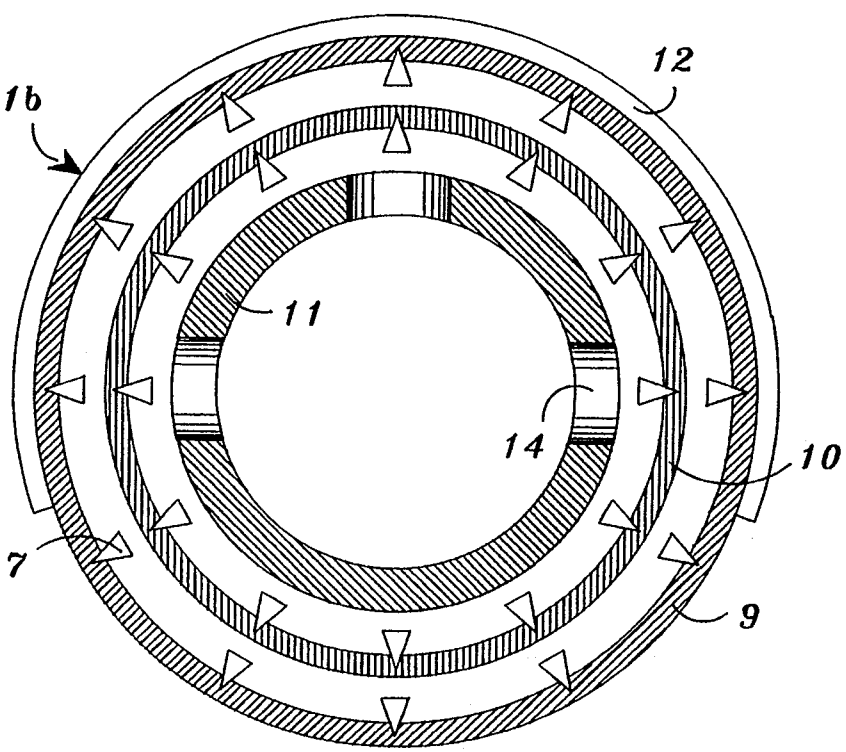
FIG. 5 illustrates a cross-sectional view of the alternate embodiment in FIG. 4 with a variation in the length of the outer shield.
Figure 4:
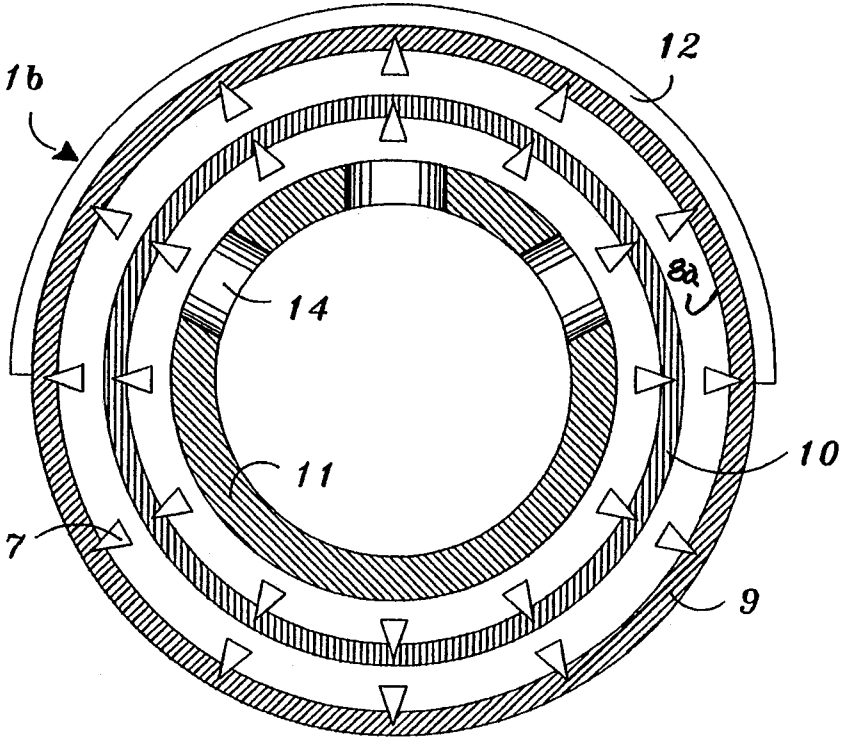
FIG. 4 illustrates a cross-sectional view of the alternate embodiment having a single shield located along the circumference of the outer most filtering screen, and the base pipe with restricted apertures.

Another design 1*b* of the alternate embodiment is shown in FIGS. 4 and 5. Two wire wrapped screens 9, 10 are fabricated of two different diameters having wire wrapping welded onto support rods 7. Approximately one-half or more of the larger diameter screen 9 is covered with a thin metal or plastic plate 12 forming a shield and thus creating a tortuous flow path. The plate 12 is affixed, by welding or bonding materials, to the full length of the larger screen 9 to fully seal the openings or gaps 8*a* in the wire wrapping 8 over the areas that they cover. Alternately, a sealant may be substituted for the plate 12 to accomplish the same function of fully closing the openings or gaps 8*a* in the larger screen 9. The smaller screen member 10 is then inserted into the larger screen member 9. The ends of the two members 9, 10 are then welded together onto a support or base pipe 11 having perforations or apertures 14 along only a portion of the periphery or circumference of the base pipe 11. The covering on the larger screen 9 is oriented in overlapping relation to the perforations or apertures 14 in the support or base pipe 11 before welding the ends to thus form the tortuous flow path. The ends of the base pipe 11 may extend some distance beyond each end of the screen portions 9, 10 to provide threaded ends for connections to other tubing or well liners. Again, it is important to maintain a tortuous flow path.

The embodiments disclosed and illustrated above (FIGS. 2–5) may be varied by providing a well liner without the base pipe 11 similar to that disclosed in the preferred embodiment 1. This option will essentially be determined by the well conditions and requirements rather than predetermined design characteristics. The need for providing such an option will also depend upon the particular use to which the well liner is put. Removal of the base pipe clearly provides less obstructed path of movement for the production fluid. Thus, where the conditions demand that a need for the base pipe is not necessary, it may be omitted. Such may be the case when the well liner is used in gas production operations.

FIG. 6 shows the preferred embodiment 1 of the invention positioned in a horizontally drilled, cased 17, cemented 16 and perforated 19 well bore 22. FIG. 7 discloses an example of the preferred embodiment 1 of the invention in a horizontally drilled open hole 23; both figures illustrate the holes as being gravel packed 18. In each case, the device is oriented so that the open wire wrapped portion of the device is toward the low side 21 of the casing 22 or open hole 23. Down hole centralizers (not shown) may be attached to the base pipe 11 between screened sections to hold the device 1 slightly off the bottom of the casing 22 or open hole 23. Gravel 18 settles to the low side 21 of either hole 22 or 23, and covers the open wire wrapped portion 3 of the device while preventing sand 15 from entering the device. Production fluid such as oil, gas or water, freely flows through the gravel 18 through the tortuous flow paths of the device. Since the high side 21*a* of the device is sealed, the present invention prevents the problem of formation sand 15 having direct access to and entering the open wire wrapping 3.

In a well where gravel 18 has not been used, or where gravel 18 fails to fully cover the lower open wire wrapping 3 of the invention, gravity will assist in preventing sand 15 from entering the well bore 22 or 23 as the density of the sand 15 is normally more than twice the density of the produced fluids. This same density difference would help prevent sand 15 from entering any horizontal well bore 22 or 23. Should the viscosity, the fluid density, and the flowing fluid velocity exceed the gravitational forces, the openings or gaps 8*a* of the wire wrapped screens 3 are designed to stop most of the formation sand particles. However, if the formation sand particles are too small to be stopped by the openings or gaps 8*a* of the open wire wrapping 3, they should be stopped by the inner screen section 3*a* of the invention 1. If a hole has eroded into the device, which is a common problem with the prior art slotted liners and wire wrapped screens, the base pipe portion 2 of the inner member 4 of the invention 1 resists continuing erosion and fluid and sand is diverted to the inner screen portion 3*a*.

As required, detailed embodiments of the present invention in the preferred and alternate embodiments are disclosed herein. However, it is to be understood that the disclosed embodiments are merely exemplary of the invention which are imparted in various forms. Therefore, specific structural and functional details disclosed herein are not to be interpreted as limiting but merely as a basis for the claims and as a representative basis for the teaching to one skilled in the art to variously employ the present invention in virtually any appropriately detailed structure.

What is claimed is:

1. A well liner for preventing sand incursion into a wellbore comprising:

a) an elongate, tubular inner member and an elongate, tubular outer member, both of said members having a first and second end and wherein said inner member is inserted within said outer member and coupled at each of said first and second ends thereto to form an annulus therebetween;

b) said inner tubular member divided axially to form first and second arcuate portions, said first arcuate portion consisting of an arcuate solid pipe and said second annular portion consisting of a tubular filter means;

c) said outer member divided axially to form first and second arcuate portions also, said first arcuate portion consisting of an arcuate filter means and said second portion consisting of a arcuate solid pipe;

d) said arcuate solid pipe of said tubular inner member being disposed annularly adjacent to said arcuate filter means of said tubular outer member with said arcuate filter means of said tubular inner member being disposed annularly adjacent to said outer member so that each said solid pipe portions prevent fluid communication with the bore; and e) a spacer means coupled to said filter means for providing support to said screen means.

2. A well liner according to claim 1, in which:

said spacer means comprises a plurality of elongate bar members circumferentially spaced and extending longitudinally about the interior surface of said screen means.

3. A well liner according to claim 1, in which:

said spacer means comprises a plurality of cylindrical sleeve members longitudinally spaced about the interior surface of said screen means.

4. A well liner according to claim 1, in which:

a centralizer means separates and holds said inner and outer members in place circumferentially and to thus provide a consistent gap between said inner and outer members.

5. A well liner according to claim 1, in which:

said first and second annular portions of said inner member and said first and second annular portions of said outer member are apportioned such that sand laden fluid communication between the well bore and said inner member occurs only though a tortuous path and any direct sand laden fluid communication is prevented.

6. A well liner according to claim 5, in which:

said first annular portion of said inner member comprises at least one-half or more solid pipe and, conversely, said second annular portion of said inner member comprises no more than one half filter means.

7. A well liner according to claim 5, in which:

said first annular portion of said outer member comprises at least one-half or more solid pipe and, conversely, said second annular portion of said inner member comprises no more than one half filter means.

8. A well liner according to claim 1, in which:

an elongate, tubular member having a plurality of spaced apertures is inserted within said inner member; said tubular member having a first and second end being coupled to said inner member at each of said first and second ends.

9. A well liner for preventing sand incursion into a wellbore comprising:

a) an elongate, tubular inner member and an elongate, tubular outer member, both of said members having a first and second end and wherein said inner member is inserted within said outer member and coupled at each of said first and second ends thereto to form an annulus therebetween;

b) said inner tubular member divided axially to form first and second arcuate portions, said first arcuate portion consisting of an arcuate solid pipe and said second annular portion consisting of a tubular filter means;

c) said outer member divided axially to form first and second arcuate portion also, said first arcuate portion consisting of an arcuate filter means and said second portion arcuate solid pipe;

d) said arcuate solid pipe of said tubular inner member being disposed annularly adjacent to said arcuate filter means of said tubular outer member with said arcuate filter means of said tubular inner member being disposed annularly adjacent to said out member so that each said solid pipe portions prevent fluid communications with the bore; and e) a spacer means coupled to said filter means for providing support to said screen means, f) an elongate, tubular member having a plurality of spaced apertures inserted within said inner member; said tubular member having a first and second and being coupled to said inner member at each of said first and second ends, g) said apertures being spaced along the full periphery of said tubular member.

10. A well liner of claim 8, in which:

said apertures are spaced along only a portion of the periphery of said tubular member.

11. A well liner of claim 9, in which:

said apertures are spaced along the full periphery of said tubular member;

a plate is affixed to said tubular member along a portion of said periphery for preventing fluid communication through said apertures.

12. A well liner of claim 9, in which:

said apertures are spaced along the full periphery of said tubular member;

a sealant is applied to said tubular member along a portion of said periphery for preventing fluid communication through said apertures.

13. A well liner according to claim 9, 10, 11 or 12 in which:

said first and second annular portions of said inner member, said first and second annular portions of said outer member, and the periphery of said tubular member having solid pipe are apportioned and aligned such that sand laden fluid communication between said well bore and said tubular member occurs only though a tortuous path and any direct sand laden fluid communication is prevented.

14. A well liner comprising:

a) an elongate, tubular inner member having a plurality of spaced apertures;

b) an elongate, tubular outer member divided axially to form a first and second annular portion; said first annular portion consisting of a tubular solid pipe and said second annular portion consisting of a tubular filter means; said solid pipe preventing sand laden fluid communication with a well bore; and said filter means having openings therethrough so as to be in fluid communication with the well bore;

c) both of said members having a first and second end and wherein said inner member is inserted within said outer member and coupled at each of said first and second end;

d) a spacer means coupled to said screen means for providing support to said screen means.

15. A well liner comprising:

a) an elongate, tubular inner member having a plurality of spaced apertures;

b) an elongate, tubular out member divided axially to form a first and second annular portion; said first annular portion consisting of a tubular solid pipe and said second annular portion consisting of a tubular filter means having openings therethrough so as to be in fluid communication with the well bore;

c) both of said members having a first and second end and wherein said inner member is inserted within said outer member and coupled at each of said first and second end;

d) a spacer means coupled to said screen menas for providing support to said screen means, e) said apertures being spaced along the full periphery of said inner member.

16. A well liner according to claim 14, in which:

said apertures are spaced along only a portion of the periphery of said inner member.

17. A well liner according to claim 15, in which:

said apertures are spaced along the full periphery of said inner member;

a plate is affixed to said inner member along a portion of said periphery for preventing sand laden fluid communication through said apertures.

18. A well liner according to claim 15, in which:

said apertures are spaced along the full periphery of said inner member;

a sealant is applied to said inner member along a portion of said periphery for preventing fluid communication through said apertures.

19. A well liner according to claim 15, 16, 17 or 18 in which:

the periphery of said inner member having no fluid communication and the periphery of said outer member having no fluid communication are apportioned and aligned such that direct fluid communication between the well bore and said inner member occurs only through a tortuous path and any direct fluid communication is prevented.

20. A well liner according to claim 14, in which:

said spacer means comprises a plurality of elongate bar members circumferentially spaced and extending longitudinally about the interior surface of said filter means.

21. A well liner according to claim 14, in which:

said spacer means comprises a plurality of cylindrical sleeve members longitudinally spaced about the interior surface of said filter means.

22. A well liner according to claim 14, in which:

said inner and outer members are separated and held in place circumferentially by a centralizer means and thus providing a consistent gap between said inner and outer members.

23. A well liner comprising:

a) an elongate, tubular member having a plurality of spaced apertures therethrough; said tubular member having a first and second end;

b) a first spacer means aligned along the periphery of said tubular member for forming a first, longitudinal fluid flow annulus in fluid communication with said spaced apertures on said tubular member;

c) a first screen means surrounding and coupled to said spacer means to form the exterior of said first annulus and having openings therethrough so as to be in fluid communication with said first annulus and said spaced apertures; said first screen means further coupled to each of said first and second ends;

d) a first shield means affixed to a portion of said first screen means for preventing fluid communication with said openings on said first screen means;

e) a second spacer means surrounding and aligned along the periphery of said first screen means and said first shield means for forming a second, longitudinal fluid flow annulus in fluid communication with said openings in said first screen means, said first annulus and said spaced apertures on said tubular member;

f) a second screen means surrounding and coupled to said second spacer means to form the exterior of said second annulus and having openings therethrough so as to be in fluid communication with said second annulus, said first annulus, and said spaced apertures on said tubular member; said second screen means further coupled to each of said first and second ends; and g) a second shield means affixed to a portion of said second screen means for preventing fluid communication with said openings on said second screen means.

24. A well liner according to claim 23, in which:

said first shield means comprises a metal plate affixed to a portion of said first screen means.

25. A well liner according to claim 23, in which:

said second shield means comprises a metal plate affixed to a portion of said second screen means.

26. A well liner according to claim 23, in which:

said first shield means comprises a plastic plate affixed to a portion of said first screen means.

27. A well liner according to claim 23, in which:

said second shield means comprises a plastic plate affixed to a portion of said second screen means.

28. A well liner according to claim 23, in which:

said first shield means comprises a sealant covering a portion of said first screen means.

29. A well liner according to claim 23, in which:

said second shield means comprises a sealant covering a portion of said second screen means.

30. A well liner according to claim 23, in which:

said first shield means opposingly faces said second shield and are aligned such that direct fluid communication between the well bore and said tubular member occurs only through a tortuous path and any direct fluid communication is prevented.

31. A well liner according to claim 23, in which:

the widths of said first and second shield means are apportioned such that direct fluid communication between the well bore and said tubular member occurs only through a tortuous path and any direct fluid communication is prevented.

32. A well liner according to claim 31, in which:

the width of said first shield means comprises at most one-half of the periphery of said first screen means, and the length of said first shield means comprises the length of said first screen means.

33. A well liner according to claim 31, in which:

the width of said second shield means comprises at least one-half or more of the periphery of said second screen means, and the length of said second shield means comprises the length of said tubular member.

34. A well liner, comprising:

a) an elongate, tubular member having a first and second end, said tubular member having a plurality of spaced apertures along a portion of said tubular member;

b) a first spacer means aligned along the periphery of said tubular member for forming a first, longitudinal fluid flow annulus in fluid communication said spaced apertures on said tubular member;

c) a first screen means surrounding and coupled to said spacer means to form the exterior of said first annulus and having openings therethrough so as to be in fluid communication with said first annulus and said spaced apertures; said first screen means further coupled to each of said first and second ends;

d) a second spacer means surrounding and aligned along the periphery of said first screen means for forming a second, longitudinal fluid flow annulus in fluid communication with said openings in said first screen means, said first annulus and said spaced apertures on said tubular member;

e) a second screen means surrounding and coupled to said second spacer means to form the exterior of said second annulus and having openings therethrough so as to be in fluid communication with said second annulus, said first annulus, and said spaced apertures on said tubular member; said screen means further coupled to said tubular member at each of said first and second ends;

f) a shield means affixed along a portion of the periphery of said second screen means such that direct fluid communication between the well bore and said tubular member occurs only through a tortuous path and any direct fluid communication is prevented.

35. A well liner of claim 34, in which:

said shield means and said spaced apertures on said tubular member are aligned in the same direction such that direct fluid communication between the well bore and said tubular member occurs only through a tortuous path and any direct fluid communication is prevented.

36. A well liner of claim 35, in which:

the width of said shield means comprises at least one-half or more of the periphery of said second screen means, and the length of said shield means comprises the length of said second screen means.

37. A well liner of claim 35, in which:

said spaced apertures on said tubular member are apportioned such that said apertures occur at most along one-half of the periphery of said tubular member.

38. A well liner of claim 34, in which:

said shield means comprises a metal plate affixed to a portion of said second screen means.

39. A well liner of claim 34, in which:

said shield means comprises a plastic plate affixed to said second screen means.

40. A well liner of claim 34, in which:

said shield means comprises a sealant covering said openings in said second screen means.

* * * * *